United States Patent [19]

Spanjersberg et al.

[11] 4,383,644

[45] May 17, 1983

[54] PROCESS AND APPARATUS FOR THE ELECTROSTATIC SPRAYING OF ELECTRICALLY CONDUCTIVE PAINT

[75] Inventors: Albertus C. Spanjersberg, Leiderdorp, Netherlands; Hans G. Mink, Stuttgart, Fed. Rep. of Germany; Johannes H. M. Barwegen, Apeldoorn, Netherlands

[73] Assignee: Akzo N.V., Netherlands

[21] Appl. No.: 236,549

[22] Filed: Feb. 20, 1981

Related U.S. Application Data

[63] Continuation of Ser. No. 2,804, Jan. 11, 1979, Pat. No. 4,275,834.

[30] Foreign Application Priority Data

Jan. 11, 1978 [NL] Netherlands ..... 7800307

[51] Int. Cl.[3] ..... B05B 5/02

[52] U.S. Cl. ..... 239/3

[58] Field of Search ..... 239/3, 690, 691, 693, 239/694, 696, 703–708; 361/228; 118/621, 627, 629

[56] References Cited

U.S. PATENT DOCUMENTS

| | | | |
|---|---|---|---|
| 3,122,320 | 2/1964 | Beck et al. | 239/3 |
| 3,892,357 | 7/1975 | Tammy | 239/3 |
| 3,893,620 | 7/1975 | Rokadia | 239/3 |
| 3,933,285 | 1/1976 | Wiggins | 239/3 X |
| 4,017,029 | 4/1977 | Walberg | 239/3 X |

FOREIGN PATENT DOCUMENTS

| | | | |
|---|---|---|---|
| 2019466 | 4/1969 | Fed. Rep. of Germany | 239/3 |
| 62866 | 1/1955 | France | 239/3 X |

*Primary Examiner*—John J. Love
*Assistant Examiner*—Gene A. Church
*Attorney, Agent, or Firm*—Stevens, Davis, Miller & Mosher

[57] ABSTRACT

The invention relates to a process and apparatus for the electrostatic spraying of electrically conductive paint. Paint free of electric charge is intermittently fed from a main supply system to a buffer supply vessel, from which the paint is intermittently fed to a spray paint supply vessel which contains electrically charged paint.

The paint in the buffer supply vessel is already electrically charged prior to the replenishing of the spray paint supply vessel from the buffer supply vessel.

The paint in the buffer supply vessel is intermittently electrically charged and discharged.

2 Claims, 11 Drawing Figures

PROCESS AND APPARATUS FOR THE ELECTROSTATIC SPRAYING OF ELECTRICALLY CONDUCTIVE PAINT

This is a continuation of application Ser. No. 2,804, filed Jan. 11, 1979, now U.S. Pat. No. 4,275,834.

The invention relates to a process and an apparatus for the electrostatic spraying of electrically conductive, more particularly water-thinnable, paint or other liquid coating material in such a way that the liquid to be sprayed is intermittently fed while free of electric charge from a main supply system to a buffer supply vessel, from which the liquid is intermittently fed to a spray liquid supply vessel which contains a spray liquid supply which is continuously electrically charged during operation and which latter vessel is connected to one or more spray units for spraying the liquid, the main supply system being electrically insulated frm the spray liquid supply vessel.

A process of the type indicated above may be considered to be known from U.S. Pat. No. 3,122,320. Although under some circumstances reasonable results may be obtained with the known process, experiments with a similar process have shown that shortly before the intermittent replenishing of the spray liquid supply vessel and hence shortly before a connection is made between the buffer supply vessel and the spray liquid supply vessel a spark-over occurs between the two supply vessels, which is bothersome and endangers safe working conditions.

Moreover, the spraying of paint having a low electrical resistance may be considered to be more or less known from W. H. Tatton and E. W. Drew's book "Industrial Paint Application," p. 151, 1st paragraph. There it is observed that the electrostatic spraying of water-thinnable or metallic paint is not very well possible because of the electric charge leaking away from the spray guns to the supply system as a result of the very low resistance of the paint. In any case, according to the above publication, the typical advantages of electrostatic spraying will largely be undone then. Moreover, according to said publication it is necessary that the complete paint pipe lines, pumps and paint containers must be insulated, which is not only very costly, but different to realize sufficiently safely in actual practice.

In the German patent application No. 2 019 466 a description is given of a somewhat different type of process for the discontinuous electrostatic spraying of water-thinnable paint, use being made of a relatively small, movable and insulated container with paint to which a high-voltage is applied. Such a known process and apparatus are not suitable for large scale spraying of water-thinnable paints, because such a system has a too limited capacity, is insufficiently safe and only permits discontinuous operation. In view of the above-mentioned difficulties encountered so far in spraying water-thinnable paint with low electrical resistance such paints have so far not been applied on a large scale. In actual practice up till now large scale electrostatic paint spraying has been done generally with the use of dispersions consisting of pigments, binders and organic solvents. Such paints have a relatively high electrical resistance. They are in many cases pumped from one or more central containers and fed over a relatively large distance through a ring conduit to various spray stations, more particularly spray booths provided in a plant, the paint being charged to, for instance, 50–150 kV before being sprayed by guns. Since such a conventional paint has a high electrical resistance, the electric charge does not leak away, so that the paint very well lends itself to being sprayed electrostatically. A disadvantage to paints having a high electrical resistance, however, is that said organic solvents contained in it are harmful from an invironmental point of view. For further treatment and a favourable effect on environment there has been an increasingly strong wish to proceed to large scale use of said water-thinnable paints, which more particularly contain hardly any or at least less organic solvent harmful to the environment.

The invention has for its object to provide a process of the type described in the opening paragraph which no longer displays the above-mentioned drawbacks.

The process for the electrostatic spraying of electrically conductive paint or other liquid coating material in such a way that the liquid to be sprayed is intermittently fed while free of electric charge from a main supply system to a buffer supply vessel, from which the liquid is intermittently fed to a spray liquid supply vessel which contains a spray liquid supply which is continuously electrically charged during operation and which latter vessel is connected to one or more spray units for spraying the liquid, the main supply system being electrically insulated from the spray liquid supply vessel, is characterized according to the invention in that to the liquid in the buffer supply vessel a voltage is already charged before the liquid in the buffer supply vessel or the parts conductively connected thereto are at the voltage applied, at a charge bridging or spark-over distance from the electrically charged liquid in the spray liquid supply vessel or the parts conductively connected thereto. As a result, there will be no spark-over between the buffer supply vessel and the spray liquid supply vessel shortly before the spray liquid supply vessel is replenished which will contribute to improving safe working conditions and particularly to greatly reducing explosion hazard. If according to the invention after the spray liquid supply vessel has been replenished, the electric charge on the remaining liquid in the buffer supply vessel or the parts conductively connected thereto is removed after the liquid in the spray liquid supply vessel or the parts conductively connected thereto are no longer at a spark-over or charge bridging distance from the electrically charged liquid in the spray liquid supply vessel or the parts conductively connected thereto, then there also will be no sparking after the spray liquid supply vessel has been replenished when the buffer supply vessel and the spray liquid supply vessel move away from each other. Favourable results are obtained if the process according to the invention is characterized in that the liquid in the buffer supply vessel or parts conductively connected thereto is electrically charged or discharged when said distance between the liquid in the spray liquid supply vessel or parts conductively connected thereto and the liquid in the buffer supply vessel or parts conductively connected thereto is more than 5–25 cm.

The electric charging or discharging of the liquid in the buffer supply vessel or the parts conductively connected thereto is advantageously carried out gradually.

According to the invention the liquid in the buffer supply vessel is electrically charged prior to the replenishing of the spray liquid supply vessel from the buffer supply vessel. It will be clear that when the buffer supply vessel is being charged, the voltage to be applied to it is brought to practically same value as that of the voltage applied to the liquid in the spray liquid supply vessel.

According to the invention the electric discharging of the liquid in the buffer supply vessel or the parts conductively connected thereto is carried out prior to the buffer supply vessel being replenished from the main supply system.

If the process according to the invention is characterized in that during the replenishing of the spray liquid supply vessel the electrically charged liquid from the buffer supply vessel is fed into the spray liquid supply vessel at a point below the level of the liquid in it, then there will be no foaming during replenishing.

The process according to the invention can be effectively realized if the buffer supply vessel is periodically displaced between the main supply system and the spray liquid supply vessel.

The process according to the invention is with advantage characterized in that said replenishing of the buffer supply vessel and the spray liquid supply vessel, the electric charging and possibly other process steps are automatically controlled, which can be effected in a simple manner by using the output signals of measurements of the liquid level in the spray liquid supply vessel.

A favourable embodiment of the process according to the invention is characterized in that liquid free of electric charge is fed through the main supply conduit serving a number of spray stations, more particularly, spray booths, and that at each spray station liquid is intermittently fed via said buffer supply vessel and a spray liquid supply vessel, which during operation contains electrically charged liquid, to spray units connected thereto.

The invention also comprises an apparatus for carrying out said process, which apparatus is provided with a main supply system, a buffer supply vessel, which can be intermittently replenished with liquid from the main supply system, a spray liquid supply vessel connected to one or more spray units, which spray liquid supply vessel can be intermittently replenished from the buffer supply vessel, which apparatus is characterized in that switching elements are provided by which the liquid in the buffer supply vessel can already be electrically charged before the liquid in the buffer supply vessel or the parts conductively connected thereto are at a charge bridging or spark-over distance from the electrically charged liquid in the spary liquid supply vessel or the parts conductively connected thereto.

An effective embodiment of the apparatus is characterized according to the invention in that the switching elements are so constructed that the electric charging of the liquid in the buffer supply vessel or the parts conductively connected thereto takes place when said distance between the liquid in the spray liquid supply vessel or the parts conductively connected thereto and the liquid in the buffer supply vessel or the parts conductively connected thereto is more than 5–25 cm. The apparatus according to the invention is with advantage characterized in that the switching elements are so constructed that the conductive connection between the buffer supply vessel and the spray liquid supply vessel which is charged to high voltage can be broken when the distance between the liquid in the spray liquid supply vessel or the parts conductively connected thereto and the liquid in the buffer supply vessel or the parts conductively connected thereto is more than 5–25 cm.

A favourable embodiment according to the invention as far as safety is concerned is characterized in that the switching elements are housed in a space which is substantially shut off from the environment, with the contacts of the switching elements being located in an oil-filled space.

A simple embodiment of the apparatus in which for the replenishing of the spray liquid supply vessel a relative displacement of the feed elements takes place is characterized according to the invention in that said displacement of the feed elements is connected to the control of said switching elements.

An effective embodiment of the apparatus in which for replenishing purposes the buffer supply vessel can be displaced between the spray liquid supply vessel and the main supply system, is characterized according to the invention is that the switching elements are formed by a few conductors axially displaceable relative to each with some lost motion, which conductors are at one end conductively connected to the movable buffer supply vessel and at the other end, via contacts which are movable relative to each other and placed in an enclosed space which is at least partly filled with oil, conductively connected periodically to electrically charged parts of the spray liquid supply vessel.

The movability of the buffer supply vessel which is provided at its base with a feed nozzle is such according to the invention that the outlet end of the feed nozzle is below the level of the liquid during the replenishing of the spray liquid supply vessel.

At its lower end the feed nozzle is provided with a valve which can cooperate with a opening element placed below the liquid level in the spray liquid supply vessel and near the bottom thereof. Moreover, according to the invention at least the spray liquid supply vessel is provided with measuring devices for the liquid level and means are provided for automatically controlling the various process steps, such as the intermittent replenishing and the relative displacement of the buffer supply vessel and the spray liquid supply vessel, and the electric charging of the buffer supply vessel.

An effective embodiment is characterized according to the invention in that the spray liquid supply vessel and the buffer supply vessel are mounted in a common framework, the buffer supply vessel being placed above the spray liquid supply vessel, with the spray liquid supply vessel and the buffer supply vessel being so mounted in the framework that they are electrically insulated therefrom.

After the spray liquid supply vessel has been replenished the electric charge can be removed from the buffer supply vessel in a simple way if the apparatus according to the invention is characterized in that the buffer supply vessel is attached to the earthed framework via a conductor having an electric resistance of at least about 2000–5000 megohm.

According to the invention the buffer supply vessel is advantageously so mounted in the framework that it can be displaced in vertical direction, which displacement can be automatically controlled at the command of level meters provided in the spray liquid supply vessel and the buffer supply vessel. Safe working conditions may still be improved if according to the invention there is provided a metal cage, more particularly a Faraday cage, which cage surrounds the framework with the two supply vessels and is conductively connected to the earthed framework.

Saftey may even be further improved if, according to the invention, on the framework with buffer supply vessel and spray liquid supply vessel there is provided a detector for detecting electric charges on the framework, which detector is connected to a device for switching off the apparatus, more particularly for removing the electric charge therefrom.

If, according to the invention, the pump for electrically charged liquid is provided inside the spray liquid supply vessel, more particularly entirely or partially below the level of the liquid, then a particularly compact construction is obtained and the leakage of electricity will be limited. The process according to the invention can in principle be successfully applied in various stages of the painting process, namely for applying a primer, a finishing coat or an intermediate coat.

If different colours of paint are to be sprayed, then it is possible according to the invention for each colour to be fed from a special buffer supply vessel and liquid spray supply vessel. The process according to the invention may with advantage be made use of in a fully or highly automated paint plant for series production.

The invention will be further described with reference to the accompanying schematic drawings.

FIGS. 9 and 10 again depict the principle of a system for spraying watersoluble paint in a strongly simplified form.

Figure 11:
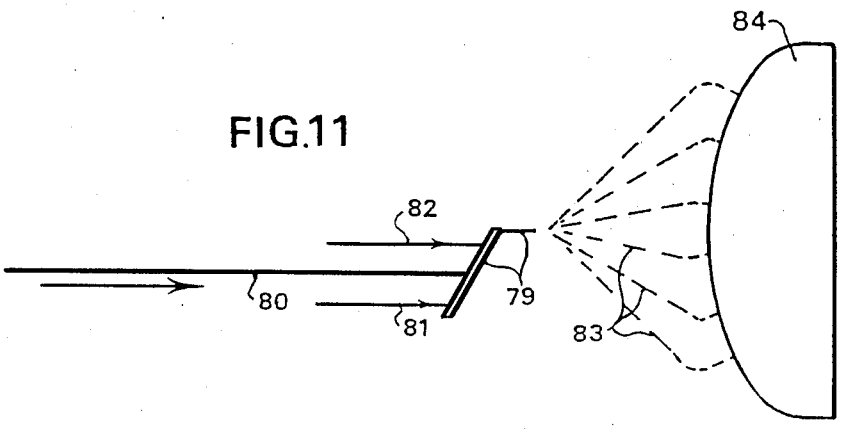

FIG. 11 shows a situation at the spray point.

Figure 1:
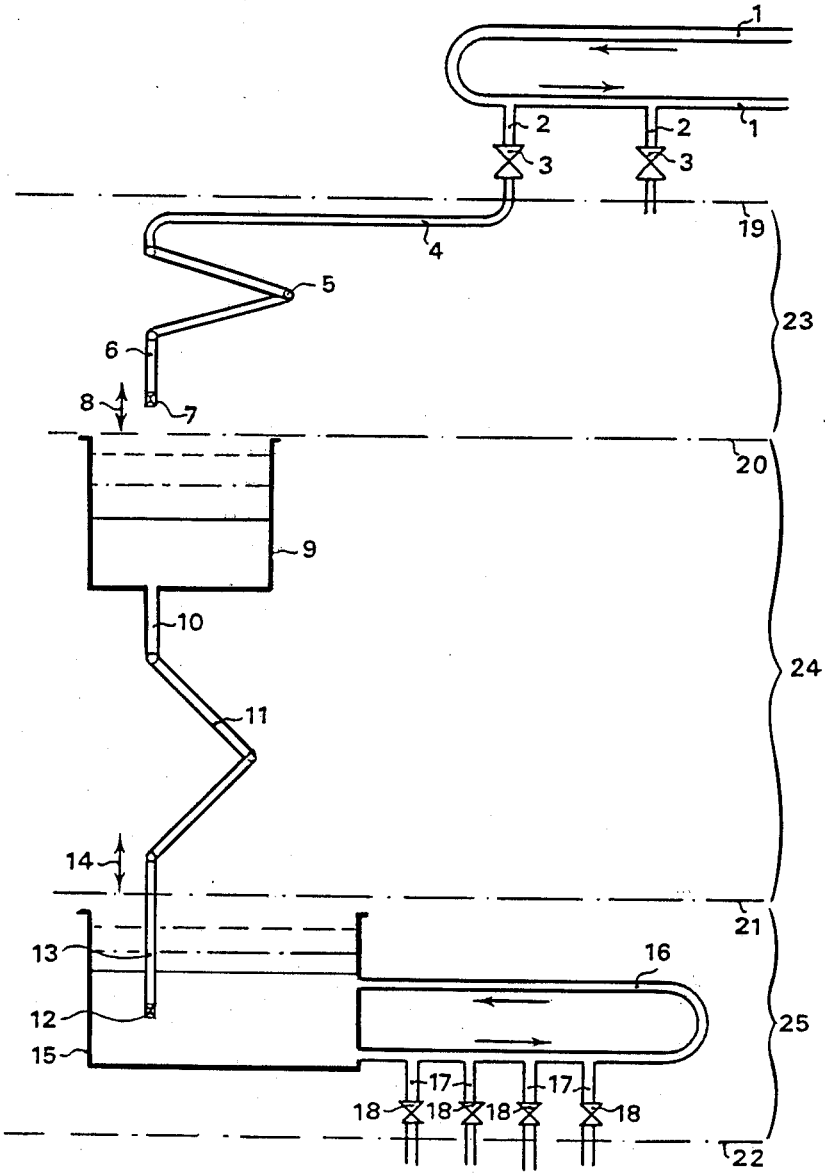
FIG. 1 shows a particular embodiment of part of a system according the invention for automatically spraying water-soluble paint.

FIG. 1 shows a ring conduit 1 through which a water-soluble paint is pumped. The ring conduit 1 is fed from a central supply vessel (not shown), from which the ring conduit 1 may extend through a plant over a relatively long distance. The length of the ring conduit may vary from twenty to a few hundred meters. The ring conduit 1 is provided with a number of branch lines 2, only two of which are indicated in the drawing and which each have a valve 3. For the sake of simplicity the construction of the apparatus is given for one branch line 2 only. Past the valve 3 the line 4 comprises a hinged section 5 which communicates with a nozzle 6 at whose lower end there is provided a valve 7. With the aid of pneumatic operating members (not shown) the nozzle is adapted to reciprocate up and down in the direction indicated by the arrow 8 owing to the presence of the hinged section 5. The nozzle ends above a buffer supply vessel 9, with the minimum paint level being indicated by a full line and the maximum level by a broken line. At the bottom of the vessel 9 there is provided a discharge line 10 which also leads to a nozzle 13 provided with a valve 12 by way of a hinged section 11, which nozzle can also reciprocate up and down in the direction indicated by the arrow 14 by means of pneumatic operating members (not shown). The nozzle 13 ends above the spray liquid supply vessel 15, with the minimum and the maximum level of the water-soluble paint being given by a full and a broken line, respectively. The spray liquid supply vessel 15 is in its turn connected to a secondary circulation system whose ring conduit is referred to by the numeral 16. For simplicity the ring conduit 16 is only shown schematically and provisions required in actual practice, such as a circulation pump, etc., are left out. The ring conduit 16 is provided with a number of branch lines 17 which each have a valve 18. Each branch line 17 runs in a way known in itself to an automatically operated paint spray gun (not shown); a large number of these spray guns may be accommodated in a spray booth, for instance for spraying motor car bodies.

The entire paint supply system according to FIG. 1 between the branch 2 line at the top and the branch line 17 at the bottom is divided by the dash-dot lines 19, 20, 21 and 22 into three zones 23, 24 and 25 indicated with braces. The parts of the conduit system in zone 23 and also the paint contained in them are always free of electric charge and preferably earthed. To the parts of the system in zone 24 and the paint contained in them there is periodically applied a high-tension of, for instance, 100 kV, which is required for effective electrostatic spraying of the paint. The parts of the system in zone 25 and the paint contained in them during operation are constantly subjected to the high-tension of 100 kV required for electrostatic spraying.

For further elucidation of the process and the apparatus according to the embodiment of FIG. 1, the FIGS. 2 and 3 again illustrate the most important parts, like numerals referring to like parts.

Figure 2:
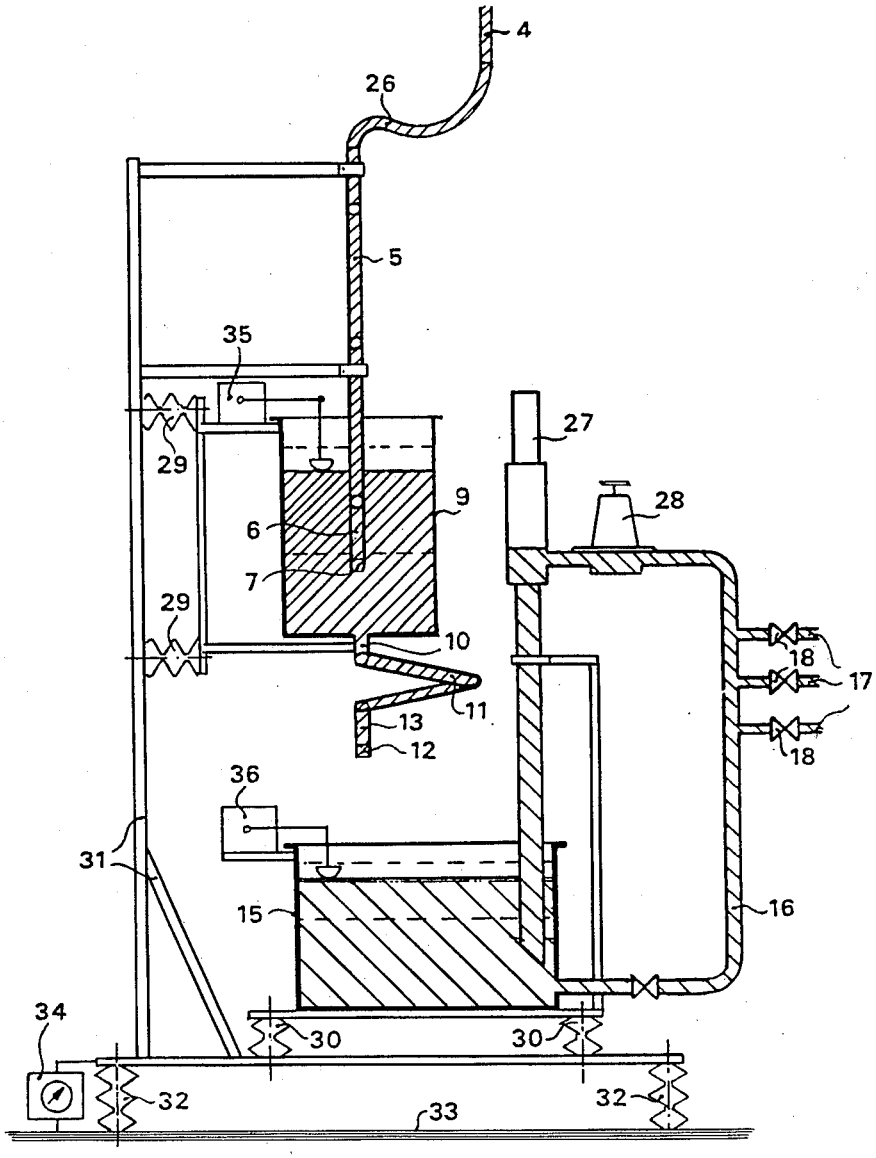
FIGS. 2 and 3 are further illustrations of the embodiment according to FIG. 1 with the buffer supply vessel and the spray liquid supply vessel shown in different situations.
Figure 3:
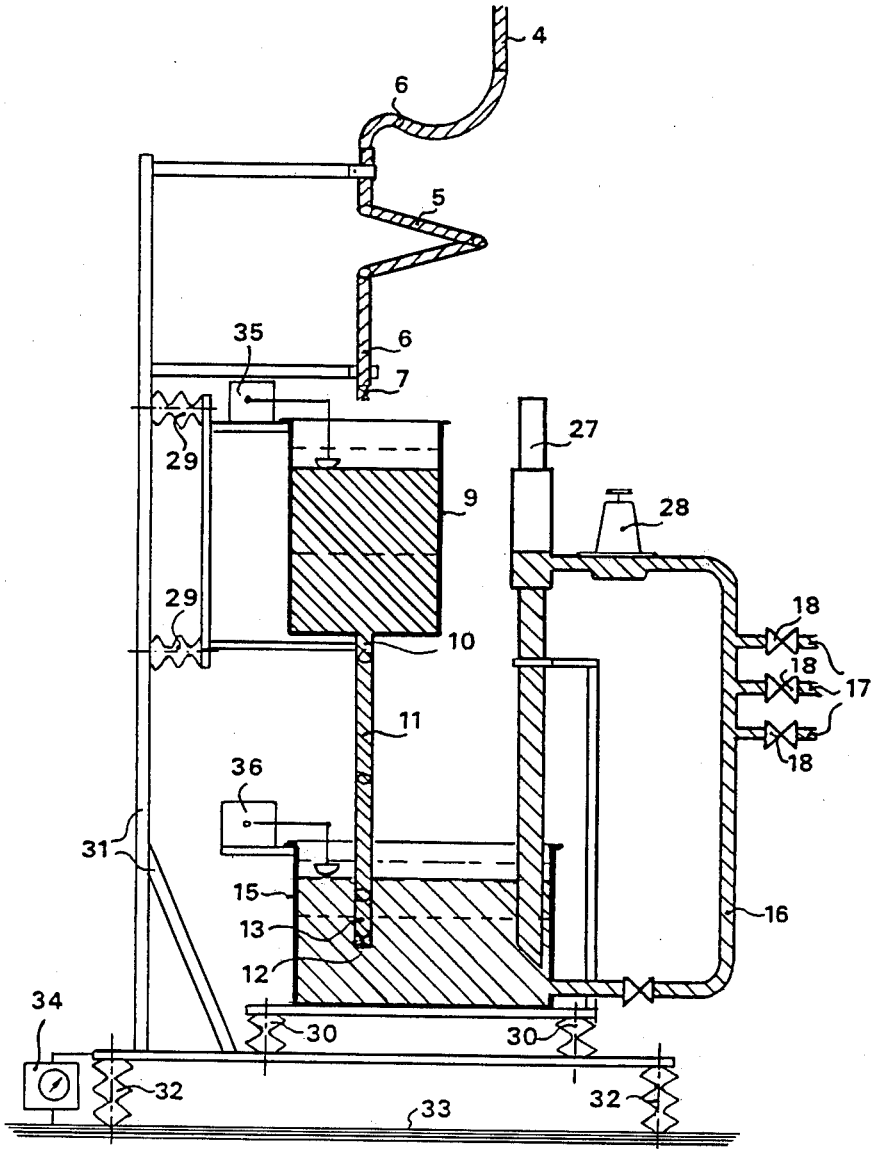

In the construction according to the FIGS. 2 and 3 a tube 26 is provided between the main supply conduit 4 and the hinged section 5. Both in the buffer supply vessel 9 and in the spray liquid supply vessel 15 the maximum and the minimum levels are indicated by broken lines. The ring conduit 16 of the secondary circulation system is provided with a pump 27 and a pressure regulator 28. Moreover, the buffer supply vessel 9 and the spray liquid supply vessel 15 are attached to the frame work 31 by way of insulators 29 and 30, respectively. The frame work 31 is in its turn insulated from the plant floor 33 by insulators 32, and between the frame work 31 and the plant floor 33 there is provided a detector 34. Both the buffer supply vessel 9 and the spray liquid supply vessel 15 are provided with automatically operating level meters 35 and 36, respectively, for measuring the liquid levels in said vessels. The operation of the systems indicated in the FIGS. 1, 2 and 3 is mainly as follows. From one or more centrally positioned vessels (not shown) containing a supply sufficient for, say, one or a couple of days, the water-soluble paint is pumped through the ring conduit 1 in the direction indicated by the arrow. Through an open valve 3 the paint flows into a main supply line 4 in the respective system for feeding a particular spray station or spray booth. In the situation illustrated in FIG. 2 the nozzle 6 of the main supply line is connected with the buffer supply vessel via pneumatic operating members known in themselves (not shown), and the open valve 7 is positioned below the minimum level in the buffer supply vessel 9. In this situation the buffer supply vessel 9 is replenished. As appears from FIG. 2, when the vessel 9 is being replenished, it is not connected with (and hence disconnected and insulated from) the spray liquid supply vessel 15 to which permanently a high voltage is applied. To this end the nozzle 13 and its valve 12 are displaced into the position at some distance above the spray liquid supply vessel 15, as shown in FIG. 2. As soon as the maximum level in the vessel 9 has been reached, the valve 7 is closed by the level meter 35 via a transmitting device and the nozzle is raised into the position shown in the FIGS. 3 and 1, in which position the main supply line 4 and the buffer supply vessel 9 consequently no longer communicate with each other and are therefore disconnected. In the position drawn in FIG. 2 the buffer supply veseel is not electrically charged, so that also the main supply conduit 4 and the earthed main ring conduit 1 are free of electric charge, the paint contained in the main supply line and the ring conduit 1 also being free of electric charge then. Both in the situation drawn in FIG. 2 and in FIG. 3 and always during operation the paint contained in the spray liquid supply vessel 15 will be permanently subjected to the high voltage of, for instance, 100 kV, required for the proper electrostatic spraying of paint. From the vessel 15 the paint to which the high voltage is applied is pumped through the secondary ring conduit 16 by the pump 27, after which the paint is fed in a known manner through one or more branch lines 17 and via the open valves 18 to a number of spray guns not shown in the drawing. In the FIGS. 2 and 3 the parts to which intermittently a high voltage is applied are differently hatched. As long as the paint in the spray liquid supply vessel 15 is still above the level indicated by a broken line, the situation just below the vessel 9 remains as it is shown in FIG. 2. However, the moment the automatic level meter 35 detects that the minimum level in the vessel has been reached or shortly before said moment, first of all the contents of the buffer vessel are gradually subjected to the same high voltage as the contents of the spray liquid supply vessel with the aid of resistors, and via a transmitting device (not shown, in the drawing). Subsequently, with the aid of pneumatic operating members known in themselves and not shown in the drawing the nozzle 13 is connected with the spray liquid supply vessel or at least lowered until the valve 12 positioned at the lower end of said nozzle 13 is in its lowest position below the liquid level in the vessel 15. The valve 12 is then opened and the replenishing of the vessel 15 from the buffer supply vessel 9 will start. The replenishing of the spray liquid supply vessel will continue until the maximum level indicated by the broken line has been reached, which is detected by the level meter 36, after which the valve 12 is closed and the nozzle 13 is raised back pneumatically into the position drawn in FIG. 2 and consequently disconnected from the spray liquid supply vessel 15. Subsequently, the high voltage applied to the buffer supply vessel 9 and its contents is gradually reduced in a manner not drawn and with the aid of resistors until the buffer supply vessel and its contents are entirely free of electric charge. At the command of its level meter 35 the buffer supply vessel 9 can again be connected now with the nozzle 6 of the main supply line 4 and be replenished in the above-described way. The buffer supply vessel 9 and the spray liquid supply vessel 15 may be of different capacities, for instance of 30 liters and 100 liters, respectively. The valves 7 and 12 in the FIGS. 1, 2 and 3 are preferably of the type described in the Netherlands Pat. Nos. 148 719 and 149 302.

According to the invention the nozzles 6 and 13 are rounded off at their lower ends and given a radius of curvature which is approximately equal to half the outer diameter of the nozzles. According to a favourable embodiment of the invention the pump 27 and the pressure regulator 28 shown in the FIGS. 2 and 3 also could be placed within the walls of the vessel 15 and partially be immersed in the liquid, as is indicated in FIG. 7. According to the invention also the upper rims of the supply vessels and other more or less projecting constructional components may with advantage be suitably rounded off, as shown by the upper rims 90 and 91 of the vessels 15 and 9 in FIGS. 5, 6 and 7.

Figure 4:
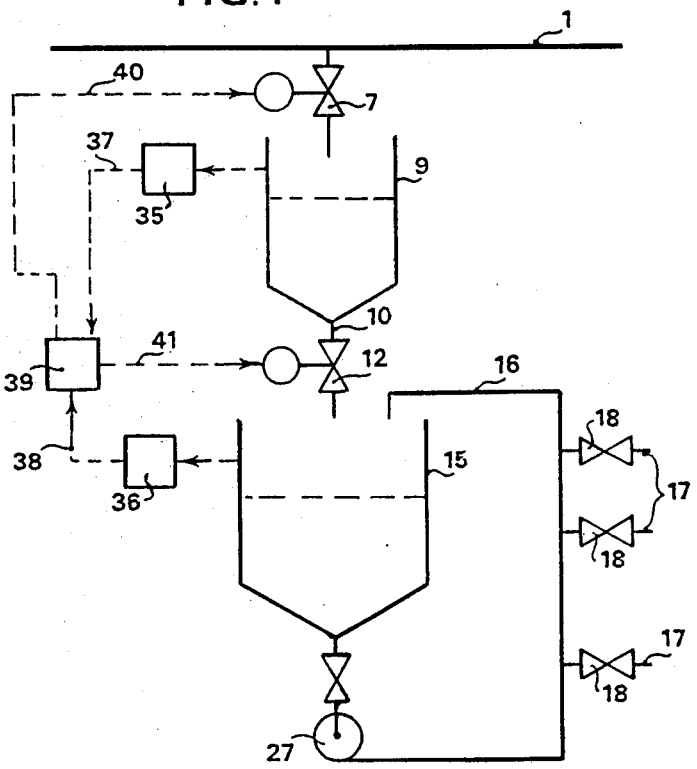
FIG. 4 shows the principle of the automatic control of the embodiment according to the FIGS. 1–3.

FIG. 4 depicts a greatly simplified embodiment according to the FIGS. 1, 2 and 3, like parts being referred to by like numerals. The broken lines 37 and 38 indicate the transmitting devices between the level meters 35, 36, respectively, and the control device 39. The control device 39 connects via the transmitting devices 40 and 41 with the valves 7 and 12, respectively. As described hereinbefore, the valves 7 and 12 can be moved up and down and be opened or closed depending on the output signals of the level meters 35 and 36.

Figure 5:
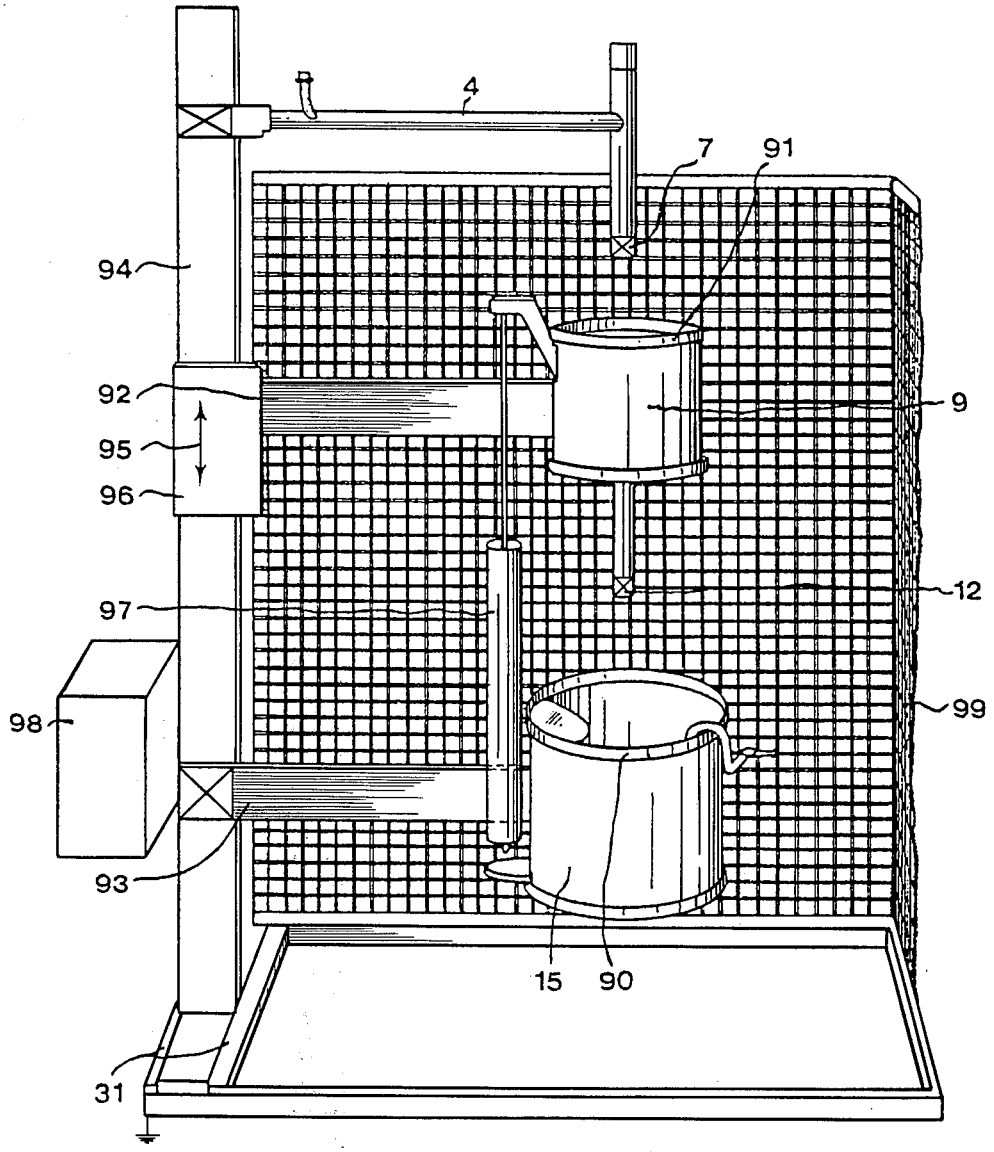
FIGS. 5–7 are perspective views of different parts of the apparatus according to the invention.

FIG. 5 shows a somewhat varied embodiment of the apparatus according to the invention, like parts being referred to by like numerals. Two metal vessels 9 and 15 are attached to a vertical beam 94 of the earthed frame 3 by means of brackets 92 and 93 of electrically insulating material. The buffer supply vessel 9 is displaceable in its entirety in vertical direction indicated by the arrow 95 in that the bracket 92 is moveable on the beam 94 by means of a guide block 96 bearing on rollers. Provided in a tube 97 partly filled with oil are switching elements for electrically charging the buffer supply vessel 9. In a switch box 98 are various elements for said automatic control of the various process steps, such as the replenishing of the two vessels 9 and 10 and the vertical displacement of the buffer vessel 9 relative to the spray liquid supply vessel 15.

Further, the apparatus shown in FIG. 5 is surrounded by a metal cage 99, a so-called cage of Faraday, which cage is conductively connected to the frame 31.

Figure 6:
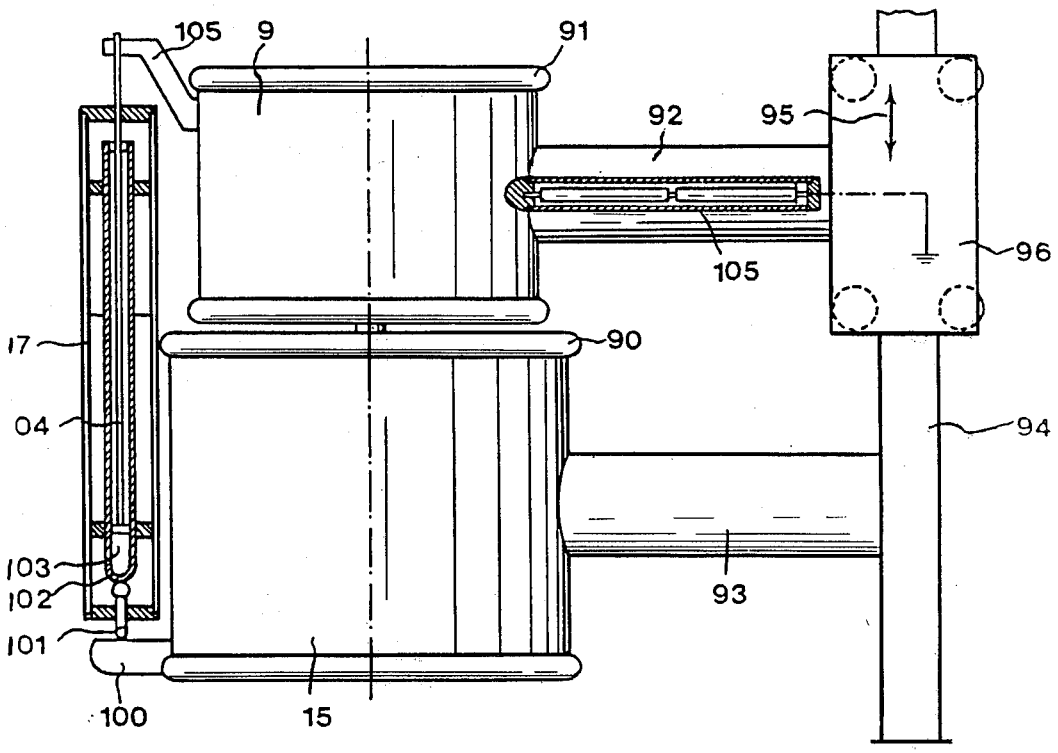
Figure 7:
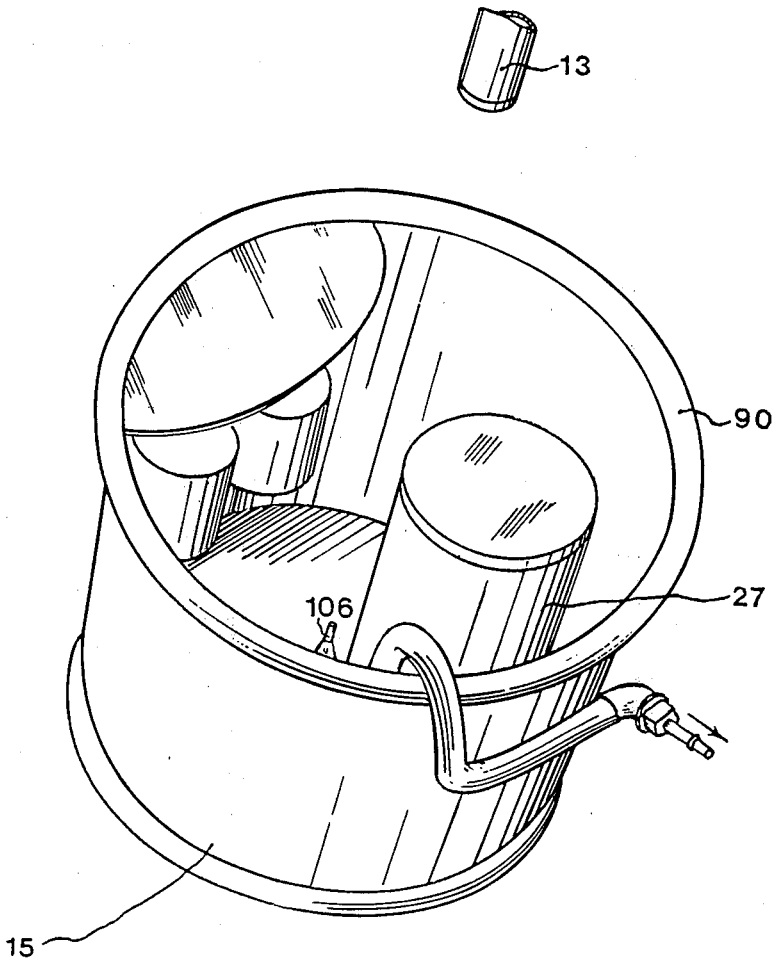

FIG. 6 shows part of the apparatus according to the invention in side elevation with the buffer supply vessel 19 in the position for the replenishing of the spray liquid supply vessel 15. In such state a high voltage is charged both to the buffer supply vessel 9 and to the spray liquid supply vessel 15.

The electric charge is transmitted from the spray liquid supply 15 to the buffer supply vessel 9 by the switching elements positioned inside the tube 97 partly filled with oil. A projecting metal support 100 is subjected to the same voltage as the spray liquid supply vessel 15. A metal pin 101 projecting from the tube rests on the support 100. The pin 101 in its turn makes contact with the metal inner tube 102, which is conductively connected to a metal rod 104 through a block 103. The rod 104 is conductively connected to a metal bracket, which is formed integral with the metal wall of the buffer supply vessel 9. As a result, the high voltage charge to the point in the spray liquid supply vessel is transmitted to the print in the buffer supply vessel 9 by way of the support 100, the pin 101, the inner tube 102, the block 103, the rod 104, the bracket 105 and the wall of the metal buffer supply vessel 9. Next to the bracket 92 runs a resistance tube 105, which forms an electric connection providing a resistance of about 2000 to 5000 megohm between the metal buffer supply vessel 9 and the vertical beam 94 earthed by the frame 31. The electrical resistance of the tube 105 must of course be such that there will be no undue leakage. The resistance tube 105 serves to make it possible for the electric charge to the remaining liquid in the buffer supply vessel 9 gradually to flow away after the switching elements in the tube 97 have broken the electric connection between the spray liquid supply vessel 15 and the buffer supply vessel 9.

Figure 8:
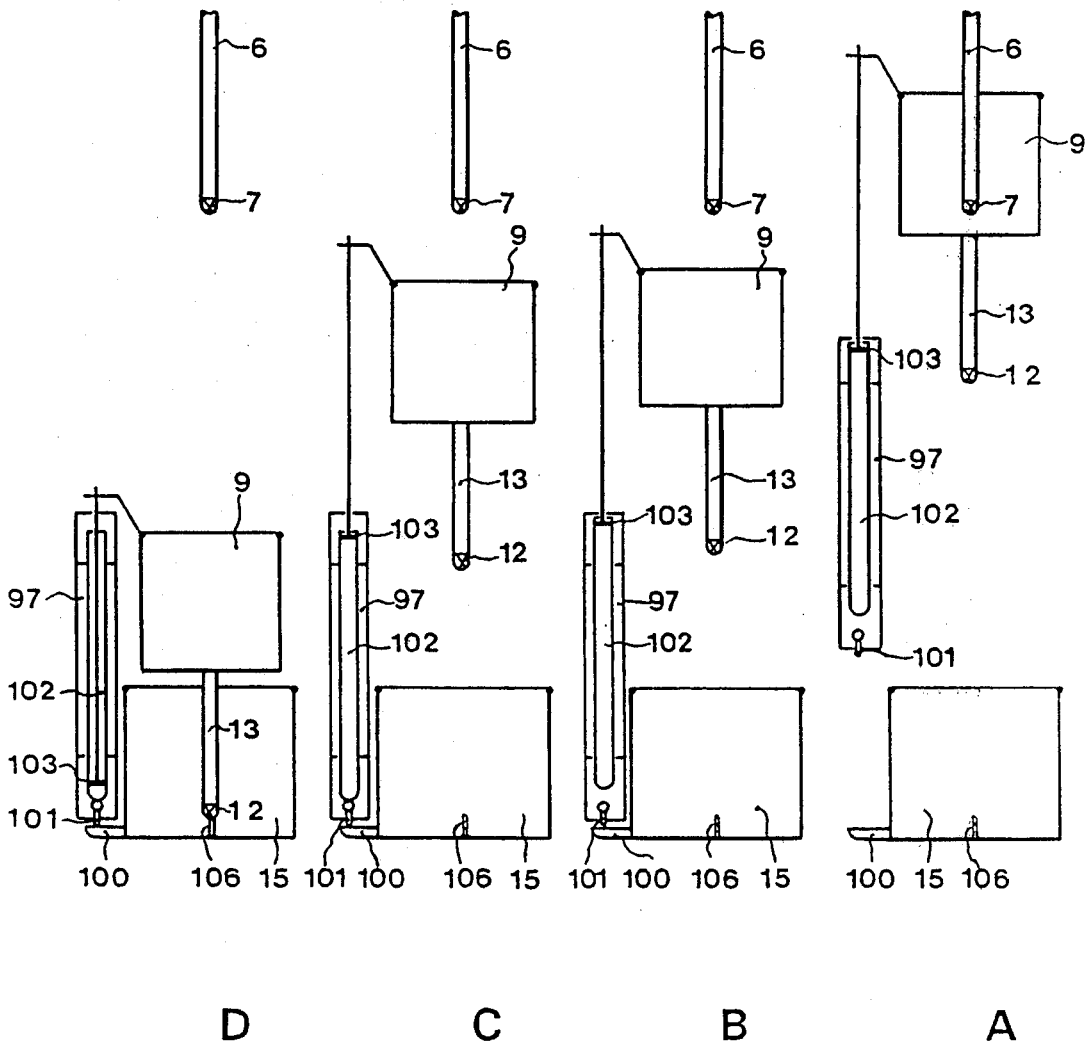
FIG. 8 shows the buffer supply vessel in different successive positions relative to the spray liquid supply vessel.

FIG. 8 is a schematic representation of the operation of the switching elements in an apparatus of the type according to FIG. 5 with the buffer supply vessel 9 in different positions relative to the spray liquid supply vessel 15, like parts being referred to by like numerals.

In FIG. 8 the buffer supply vessel 9 is shown in four successively lower positions A, B, C and D. In the highest position (A) of the buffer vessel 9 there is no electric connection between the vessels 9 and 10; and the pin 101 and the support are at a relatively great distance from each other. In position B the vessel 9 has come down for such a distance that the pin 101 and the support 100 make contact with each other; in that situation, however, there is no electric connection between the spray liquid supply vessel 15 and the buffer supply vessel 9 because the inner tube 102 and the pin 101 do not make contact with each other yet. In situation C the buffer supply vessel 9 has come down further and the inner tube 102 makes contact with the pin 101. In situation C electric contact is made between the spray liquid supply vessel 15 and the buffer supply vessel 9 and to the liquid in the vessel 9 the same high voltage charge is imparted as to the liquid in the spray liquid supply vessel 15. When the vessel 9 comes down still further, the situation D is obtained and the electrically conductive contact between the vessels 9 and 15 is maintained. As the vessel 9 moves from position C to position D only the block 103 in the inner tube 102 will be displaced as a result of the lost motion between the inner tube 102 and the block 103. There is also some lost motion between the inner tube 102 and the outer tube 97. In the lowest position the valve 12 is pushed open by means of an opening element in the form of a pin 106.

Upon completion of the replenishing operation the vessel 9 is moved upwards by the automatic control, the various positions shown in FIG. 8 being taken up in reverse order, viz. D, C, B and A.

Figure 9:
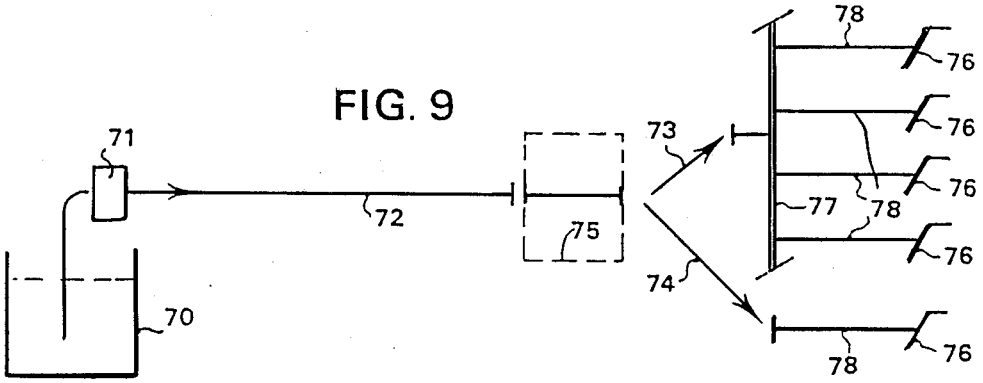

FIG. 9 is another, strongly simplified, schematic illustration of the principle of an electrostatic spray system for water-soluble paint. A vessel containing a paint free of electric charge and having a very low electrical resistance is referred to by the numeral 70. A pump 71 serves to pump the paint from the vessel 70 through a line 72 in the direction indicated by the arrow. Depending on the prevailing circumstances and the paint to be sprayed, the line 72 may be a single-line conduit or a ring conduit. The points at which the high-voltage paint are to be sprayed are indicated by the arrows 73 and 74. Provided between the feed line 72 and the spray points 73, 74 is the electrical insulation 75. The secondary supply and circulation of high-voltage charged paint at the spray points can in it self be effected in various manners and, depending on the prevailing circumstances and the kind of the paint used, a secondary ring conduit or a single-line conduit 77 may be employed to which the guns 76 are connected. In the embodiment shown in the drawing the guns 76 are connected to the line 77 by way of a single-line feed conduit 78. Depending on the prevailing circumstances and the type of paint to be sprayed the guns also may each be connected separately to the secondary circuit 77 by way of their own feed and discharge lines. The spray point 74 only has one spray gun 76 so that there is no need for a separate secondary ring conduit.

Figure 10:
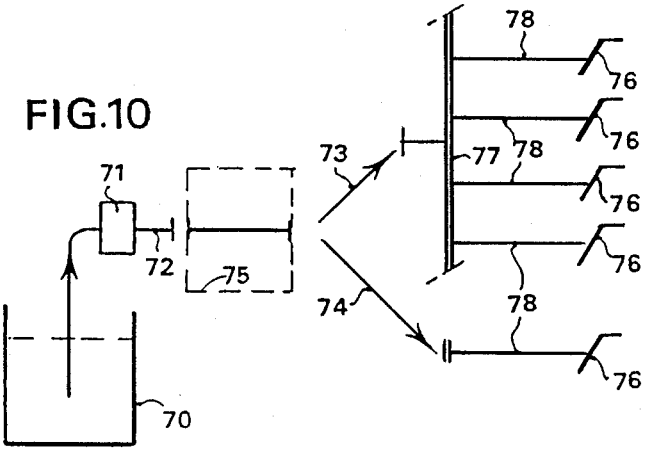

FIG. 10 illustrates an embodiment which shows great resemblance to the one according to FIG. 9, except that in the embodiment according to FIG. 10 there is only need for a very short main feed line 72 having a length of, for instance, one or a few meters. The length of the line 72 in FIG. 9 may be a few hundred meters.

FIG. 11 is still a strongly simplified picture of the situation at the spray point in the case where for instance a water-soluble paint having a very low electrical resistance and subjected to high-voltage is to be electrostatically sprayed from a gun 79 to which paint is supplied through a line 80 and at the same time compressed air is supplied through a line 81. Through a high-voltage cable 82 a high voltage is applied to the paint contained in the gun. Upon leaving the gun 79 the paint is atomized and moves along the schematically indicated rays 83 and under the influence of the electric field to the earthed object 84 to be painted. Instead of introducing the electric charge into the gun 79 with the cable 82 the electric charge could be fed to the paint in the line 80 also from some other point at some distance from the gun 79, provided that between all lines filled with high-voltage paint and the main feed line there are provisions for preventing the electric charge from flowing back to the main feed line containing the non-electrically charged paint. For example in the embodiment according to FIG. 9 the high-voltage charge can be introduced at almost any point between the outflow openings of the guns 76 and the insulation 75. The paint particles also can be electrically charged between leaving the gun and before reaching the workpiece. More particularly, it has been proposed that in the electrostatic spraying of water-soluble paint the paint particles are charged only after leaving the gun by means of an electrode mounted on the spray head. Such a method, too, however, can only be properly realized if use is made of the process and the apparatus according to the invention.

In the embodiment shown in FIG. 11 a high voltage is, as mentioned above, charged to the paint in the one gun shown in the drawing. In the electrostatic spraying of motor car bodies in highly automated plants comprising a number of spray booths each spray booth contains a large number of spray guns which may be arranged in groups for the spraying of two side surfaces and the top.

Optionally, a high voltage may then be charged per group of guns. The motor car body to be painted is earthed then. The process according to the invention may of course also be applied in painting steel furniture, refrigerators, washing machines and various other articles.

The process and the apparatus according to the invention can be used in various electrostatic spray systems which are known in themselves. One system that may be considered is electrostatic spraying with the aid of compressed air. However, the invention also may be utilized in systems assisted mechanically with a rotor or discs or be applied with the aid of high liquid pressure, for instance 100–200 bar. The present invention also may with advantage be applied in an entirely unassisted system of electrostatic spraying of paint. In principle the invention may even be applied in electrostatic spraying carried out with aid of a combination of the above-mentioned assisted systems.

The process and the apparatus according to the invention make it possible particularly to proceed to large scale use in a relatively simple, effective and safe way of water thinnable or water-soluble paints and other coating materials having a low electrical resistance, thus contributing to a further reduction of present-day environmental problems. Although the process and the apparatus according to the invention are particularly suitable for use in modern fully automatic paint spray plants, notably in the automobile industry, the invention also may with advantage be applied in relatively small plants.

As mentioned before, the process according to the invention is intended particularly for spraying products having a low electrical resistance, i.e.—a resistance of 10–10,000 Ω. In some situations, however, in the case of particular products or when use is made of a particular electrostatic process or apparatus, application of the system according to the invention also may lead to an improvement of the results when the products to be sprayed have a resistance of over 10,000 Ω. For example the invention may in principle be advantageously applied in the electrostatic spraying of metallic paints, which when properly mixed have an electrical resistance of, for instance 50,000 to 400,000 Ω, but whose electrical resistance may sometimes be considerably reduced, for instance to 0–50,000 Ω, when they are electrically charged.

The above-mentioned electrical resistances were measured with a paint resistance tester commercially available under the name Ransburg, type S 595, model 23K.

The above-mentioned water-thinnable spray products may for instance be composed as follows:

0–25 percent by weight of pigment
25–50 percent by weight of binder
1–30 percent by weight of organic solvent
20–50 percent by weight of water.

Also some polyvinyl butyral-containing etch primers, which are often referred to as wash primers, may with advantage be sprayed using the process according to the invention, just as some metal-containing, i.e. aluminum-or zinc-containing, products, often referred to as metallic paints. Within the scope of the invention various modifications may be made.

What is claimed is:

1. In a process for the electrostatic spraying of an electrically conductive liquid coating material wherein the liquid to be sprayed is intermittently fed while free of electric charge from a main supply system via a first outlet valve to a buffer supply vessel and intermittently fed from the buffer supply vessel via a second outlet valve to a second vessel which contains a supply of liquid to be sprayed and is continuously electrically charged during operation, the latter vessel being connected to at least one spray unit for spraying the liquid, the main supply system being electrically insulated from the spray liquid supply vessel, the improvement which comprises electrically charging the liquid material in the buffer supply vessel before said second outlet valve is opened and after said first outlet valve is closed.

2. The process of claim 1 wherein the coating material is a paint.

* * * * *